US006991846B2

(12) United States Patent
Mallol et al.

(10) Patent No.: US 6,991,846 B2
(45) Date of Patent: Jan. 31, 2006

(54) PAPER INCLUDING A MULTITONE-EFFECT WATERMARK, AND A WIRE FOR MANUFACTURING THE PAPER

(75) Inventors: Stéphane Mallol, Provins (FR); Yvan Thierry, Jouy sur Morin (FR)

(73) Assignee: Arjowiggins Security, Issey les Moulineaux (FR)

( * ) Notice: Subject to any disclaimer, the term of this patent is extended or adjusted under 35 U.S.C. 154(b) by 0 days.

(21) Appl. No.: 09/764,096

(22) Filed: Jan. 19, 2001

(65) Prior Publication Data

US 2001/0018113 A1 Aug. 30, 2001

(30) Foreign Application Priority Data

Feb. 1, 2000 (FR) ..... 00 01248

(51) Int. Cl.
*B32B 3/00* (2006.01)

(52) U.S. Cl. ..... 428/292.1; 428/195; 428/211

(58) Field of Classification Search ..... 428/195, 428/211, 204, 292.1; 162/140, 141, 158, 162/183, 136, 110, 103; 283/72, 109, 202
See application file for complete search history.

(56) References Cited

U.S. PATENT DOCUMENTS

| | | | | |
|---|---|---|---|---|
| 4,210,346 | A * | 7/1980 | Mowry et al. | 283/94 |
| 4,462,866 | A | 7/1984 | Tooth et al. | 162/103 |
| 4,462,867 | A | 7/1984 | Fuller | 162/103 |
| 4,600,629 | A * | 7/1986 | Knapp et al. | 428/201 |
| 5,161,829 | A * | 11/1992 | Detrick et al. | 283/91 |
| 5,275,870 | A * | 1/1994 | Halope et al. | 428/199 |
| 5,388,862 | A * | 2/1995 | Edwards | 283/82 |
| 5,678,863 | A * | 10/1997 | Knight et al. | 283/113 |
| 5,830,609 | A * | 11/1998 | Warner et al. | 430/10 |
| 5,883,043 | A * | 3/1999 | Halbrook, Jr. et al. | 503/204 |
| 5,916,416 | A * | 6/1999 | Fedrigoni et al. | 162/109 |
| 5,928,471 | A * | 7/1999 | Howland et al. | 162/110 |
| 5,932,071 | A | 8/1999 | Stielow et al. | 162/314 |
| 6,063,239 | A * | 5/2000 | Howland et al. | 162/110 |
| 6,355,140 | B1 | 3/2002 | Murakami et al. | 162/140 |
| 6,402,888 | B1 * | 6/2002 | Doublet et al. | 162/140 |
| 6,630,055 | B1 * | 10/2003 | Goguelin et al. | 162/136 |

FOREIGN PATENT DOCUMENTS

| | | |
|---|---|---|
| EP | 0 549 384 A1 | 6/1993 |
| EP | 0 773 320 A1 | 5/1997 |
| EP | 773320 A | 5/1997 |
| FR | 2 723 971 | 8/1994 |
| FR | 2 769 927 A1 | 4/1999 |
| FR | 2769927 A1 | 4/1999 |
| JP | A- 63-219692 | 9/1988 |
| WO | WO 94/20679 A1 | 9/1994 |

* cited by examiner

*Primary Examiner*—Rena Dye
*Assistant Examiner*—Camie Thompson
(74) *Attorney, Agent, or Firm*—Oliff & Berridge, PLC

(57) ABSTRACT

Paper based on a fiber composition and having at least one multitone-effect watermark. When observed in transmitted light, the watermark has a set of pale zones arranged in the manner of a screened image.

12 Claims, 2 Drawing Sheets

PAPER INCLUDING A MULTITONE-EFFECT WATERMARK, AND A WIRE FOR MANUFACTURING THE PAPER

The present invention relates to paper including a multitone-effect watermark, and to a wire for manufacturing such paper.

In the present invention, "paper" means sheet material obtained by a wet method using a suspension of natural cellulose fibers and/or inorganic or organic fibers other than cellulose, and optionally containing various fillers and various additives commonly used in papermaking.

BACKGROUND OF THE INVENTION

It is known to use the watermarking technique to make security paper, i.e. documents that must not be falsified, in particular such as bank notes, payment means, identity documents, travel tickets, and tickets for cultural or sporting events.

The purpose of having a watermark present is to make it impossible to reproduce the document by optical means such as photocopying, photography, or scanning, because the medium on which the copy is reproduced does not include the watermark of the original document.

Watermarked papers are also used for decorative purposes, particularly for prestige writing and printing papers.

Watermarks are conventionally obtained by an operation of molding or embossing the wet sheet derived from the aqueous suspension of cellulose fibers during manufacture of the paper. At this stage of manufacture, the cellulose fibers migrate easily through the aqueous suspension so that the effect of the above operation is to concentrate fibers in thicker zones of the sheet and to disperse them in thinner zones, such that after the sheet has dried, and when it is observed in transmitted light, the sheet has pale zones that are poor in fibers and dark zones that have a high density of fibers.

The pale zones are referred to as zones of low optical density, lower than that of the "parchment", i.e., in the meaning of the present application, the non-watermarked portion of the paper, and the dark zones are referred to as zones of high optical density, higher than that of the paper.

Depending on the local thickness of the watermarked zone, a desired density of fibers is obtained that corresponds to the looked-for tone shade. The pattern that appears thus includes an entire scale of tone shades, which is why such conventional "embossed" watermarks can be referred to as "shaded" watermarks.

Conventional shaded watermarks require expensive means because for each watermark pattern it is necessary to use a specific watermarking roll or wire, and these are in any event difficult to make.

Furthermore, the fact that conventional watermarked papers include regions of greater thickness gives rise to various problems.

Firstly, it slows down manufacturing rates because it is necessary regularly to stop machines that are designed for handling flat paper, in particular machines for transforming and for printing. Guillotining in particular is made difficult because the extra thicknesses of the watermarks give rise to deformation of the paper.

Another difficulty appears on printing since the way in which ink prints on the thicker zones is difficult to control, such that it is generally preferred to avoid printing on them and to print only outside the watermarked zones.

To compensate for these regions of extra thickness, the person skilled in the art puts spacers between the sheets. Such compensation is necessary to enable the sheets to be processed properly, but it requires additional and fiddly work to be performed which slows down processing of the sheets, particularly during printing.

In order to avoid those problems, attempts have already been made to produce pseudo-watermarks by using techniques that are less expensive, that conserve the initial thickness of the paper, and that provide a visual appearance that is close to that of a conventional watermark.

One known technique for making pseudo-watermarks consists in causing a composition to penetrate in or be printed on determined zones of the paper to modify the transparency of the paper and thus provide pale zones and dark zones like a watermark.

The drawback associated with that technique is that the compositions used spoil the surface properties of the paper, in particular its suitability for receiving printing inks, and the result obtained does not make it possible to obtain the same fineness and variation in brightness as in a conventional watermark.

Furthermore, such pseudo-watermarks are very easy to counterfeit since impregnating a sheet of paper with an appropriate composition is within the competence of numerous counterfeiters.

OBJECTS AND SUMMARY OF THE INVENTION

The present invention seeks to provide a novel watermarked paper that can be manufactured under conditions that are particularly simple and low in cost.

The watermark of the invention reproduces the visual appearance of a conventional shaded watermark and provides all the usual security characteristics specific to conventional shaded watermarks.

In particular, the invention provides paper based on a fiber, composition, the paper comprising at least one multitone-effect watermark, wherein the watermark, when observed in transmitted light, has a set of pale zones arranged in the manner of a screened image.

Preferably, the pale zones present a weight per unit area that is less than that of the remainder of the paper or parchment.

In other words, in the paper of the invention, the watermark appears locally in transmitted light as a juxtaposition of pale zones and of dark zones that can be distinguished from one another, the dark zones having a fiber composition with the same weight per unit area as the parchment, but appearing dark in comparison with the adjacent pale zones because of a contrast effect.

The pale zones in the meaning of the invention have low optical density because of their lower weight per unit area.

In the watermark of the invention, the pale zones of low optical density contrast with the paper of higher optical density surrounding them, and there is a finite number of optical densities, specifically the density(ies) of the pale zones and the density of the parchment.

The presence of pale zones in the parchment, with distributions that vary depending on the locations within the pattern in question, produces a macroscopic visual effect that reproduces the shading of a conventional watermark.

In other words, in a given region of the watermark, the pale zones are more or less numerous and occupy a larger or smaller fraction of the total area of the region, thereby producing an effect of more or less shading.

Preferably, all of the pale zones have the same weight per unit area, which gives rise to the same optical density in all of the pale zones, ignoring irregularities in the paper. Under such circumstances, there are two optical densities, namely that of the pale zones and that of the parchment.

To obtain a desired image, it is possible to vary the individual size of the pale zones and to vary the number thereof and the distribution thereof.

In the meaning of the present invention, the term "screened image" must be given a broad meaning covering all types of screen or pseudo-screen, and the shapes of the pale zones and of the dark zones are not limited to any particular shape but can be arbitrary.

In a particular embodiment of the invention, the paper is colored, fluorescent, iridescent, or presents any other optical effect or shade known for non-watermarked papers.

In a preferred embodiment, the watermark appears in transmitted light as a screened image whose screen marks are for the most part constituted by lines.

These lines are inclined, e.g. at 45°, but different regions of the screened image can have lines that are inclined differently.

In a particular embodiment, the screen of the screened image has amplitude modulation using a constant pitch, e.g. lying in the range 5 lines per centimeter (1/cm) to 20 1/cm.

By "amplitude modulation" it should be understood that the pale zones are larger or smaller depending on the optical density to be reproduced, being of greater extent in highlights than in lowlights.

In another particular embodiment, the screen of the screened image has frequency modulation.

By "frequency modulation", it should be understood that the pale zones are more or less numerous depending on the optical density to be reproduced, being more numerous in the highlights than in the lowlights.

It is also possible to propose other screened imaging techniques, e.g. to take account of problems associated with reproducing screen marks in regions having high or low optical density.

In particular, given the process by which paper is made, forming a pale zone of a size that is smaller than a predetermined size can give rise to difficulties.

Similarly, forming a dark zone that is smaller than a predetermined size and that is situated between two pale zones can also be difficult.

To reproduce a given shaded effect in the low lights, it is preferable to have pale zones of a size that is not difficult to make on the paper, and the number of these pale zones is selected as a function of the optical density, the higher the optical density the less numerous the pale zones.

In the high light, it is preferable to have dark zones of a size that is large enough to enable them to be made without difficulty on the paper between the pale zones, with the number of dark zones being greater or smaller depending in the optical density to be reproduced, the number of dark zones decreasing with decreasing optical density.

For regions of the watermark having brightness in transmitted light that lies between the high lights and the low lights, and for which the sizes of the dark zones and of the pale zones do not give rise to difficulties of formation on the paper, it is advantageous to modulate the size of the pale zones and the size of the dark zones as a function of the optical density to be reproduced.

The present invention also provides a wire used in the wet stage of papermaking, the wire being provided with a set of masks representing a pattern to be made as a multitone-effect watermark on the paper, the set of masks being denser in regions corresponding to the pale portions of the looked-for watermark and less dense in the regions corresponding to the dark portions when the watermark is observed in transmitted light.

The set of masks enables two local optical densities to be obtained in the resulting paper, i.e. a low optical density in register with the masks, said low optical density being the result of the fact that the masks put a limit on fiber accumulation while the sheet of paper is being formed, and a high optical density in register with the unmasked portions of the set of masks, which high optical density is the same as that observed throughout the remainder of the paper.

In a particular embodiment of the invention, the masks are of different thicknesses, thereby giving rise in the watermark to pale zones of different weights per unit area. The watermark then has more than two optical densities, thus improving its multitone effect.

The wire provided with a set of masks of the invention makes it possible to obtain a watermark imitating a conventional watermark having a multitone effect, with its various tone shades that are traditionally obtained by varying the depth to which the paper is embossed being reproduced by replacing said embossing with optical effects that result from the disposition of the masks, the number, the distribution and the shape of the masks being selected depending on the desired effect, the masks occupying a relatively large area of the wire in its regions that are to provide pale zones in the watermark and a smaller area in its regions that are to provide the darker zones of the watermark.

The invention makes it possible to avoid varying embossing depth, thus eliminating in particular the above-mentioned drawbacks of conventional watermarks associated with excess thickness.

In other words, one advantage of the wire of the invention is that it provides paper without any excess thickness because the tone shading does not result from embossing the paper to a greater or lesser extent.

The screened image reproduced by the watermark preferably has screen marks that are constituted by lines, since that makes it easier to implement the set of masks.

In a first embodiment of the invention, the wire used for forming the watermark constitutes the wire used for forming the paper.

In a second embodiment, the wire in question is the wire used for lifting paper that has already been formed.

In a third embodiment of the invention, the wire in question is the wire fixed to a wet press that operates on the still wet sheets after it has been lifted.

In a fourth embodiment of the invention, the wire in question is the wire fixed to a watermarking roll.

In a fifth embodiment of the invention, the wire in question is the wire fixed to a graining element situated outside the sheet-forming zone.

By way of example, the wire in question may be disposed on a round-shaped papermaking machine or on a flatbed papermaking machine.

In each of the above-described embodiments, the masks can be on the inside face of the wire, in the thickness of the wire, or on the outside face thereof, and a plurality of wires can be associated with one another.

The masks are preferably placed on the side of the wire that comes into contact with the aqueous suspension containing the fibers of the paper.

The invention also provides a stack of wires including at least one which is a wire as described above.

Naturally, any combination of the above-described embodiments is also possible.

The invention also provides a method of making a screened image for forming a watermark, the method comprising the following steps:

making a screened image from a scanned image by using a known screening method;

making a perforated element from said screened image and suitable for use during the aqueous stage of paper formation, said perforated element having solid regions disposed like the pale portions of the watermark; and making a watermark by means of said perforated element by placing the perforated element so that it limits accumulations of fibers in register with the solid regions of the perforated element during the aqueous stage of paper formation.

Advantageously, the above-mentioned screened image is an image having screen marks constituted by lines.

Also advantageously, the screened image is retouched prior to making the perforated element so as to ensure that no isolated pale zone exists in the watermark.

In which case, the perforated element can easily be made in the form of a one-piece plate having perforations and in which the solid portions are disposed like the pale zones of the watermark.

The watermark of the invention can be recognized by means of software for analyzing images.

Various embodiments of the set of masks used in the invention are described below.

In a first embodiment, the set of masks is constituted by a grid made from a metal plate or a plastics material plate of small thickness, having perforations formed therein. The solid portions of the gird remaining between the perforations constitute the masks in the meaning of the invention.

The perforations can be made by chemical etching, laser cutting, water-jet cutting, or mechanical drilling of the grid.

The perforations can be in the form of slanting lines leaving between them masks that are likewise in the form of slanting lines.

Under such circumstances, the presence and the density of the slanting lines determine the shade of the tone that is obtained macroscopically by juxtaposing pale zones and dark zones in the watermark.

The slanting lines can all be parallel to a given direction or they can extend in different directions. Similarly, they can provide different screen effects, so as to give the resulting watermark a personalized visual effect.

In a second embodiment, the set of masks is constituted by juxtaposing pieces that are fixed individually to the wire.

In general, the masks can be individually shaped to have a special unit pattern for personalizing the sheet of paper, creating pale zones in the thickness thereof representing the unit pattern of the masks. For example, each unit pattern can form a letter or a set of letters, e.g. characteristic of the organization issuing the security document made using the sheet of the invention.

BRIEF DESCRIPTION OF THE DRAWINGS

In order to make the invention easier to understand, there follows a description of an embodiment given by way of non-limiting example and with reference to the accompanying drawings, in which.

MORE DETAILED DESCRIPTION

Figure 1:
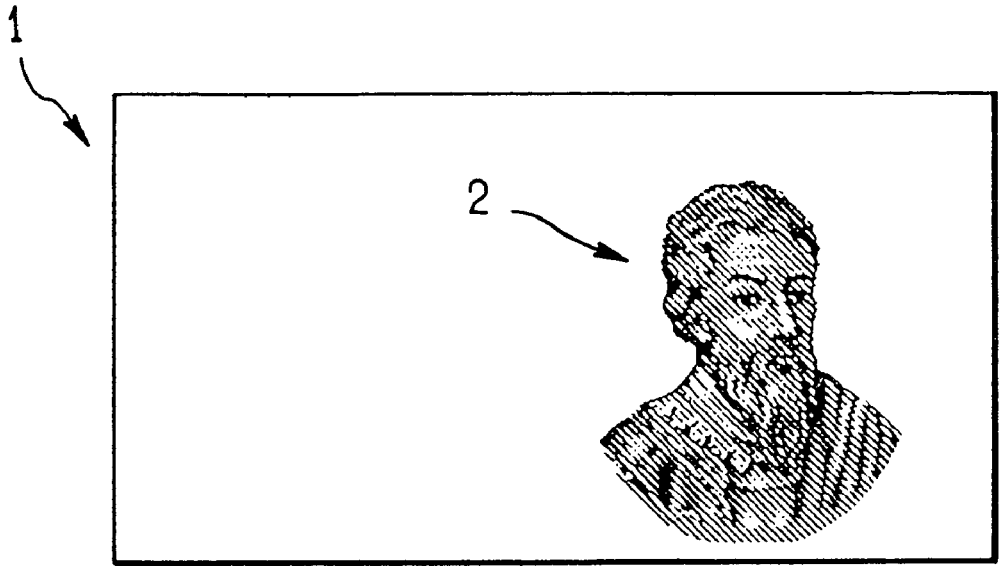
FIG. 1 is a diagram of paper having a watermark of the invention.

FIG. 1 shows a security document 1 of the invention such as a bank note, that includes a watermark 2 that is shown in highly diagrammatic manner and that reproduces an image, e.g. the portrait of a famous person.

To make the watermark 2 of FIG. 1, a set of masks is used constituted by a thin grid having perforations that give a negative image of the watermark.

Figure 2:
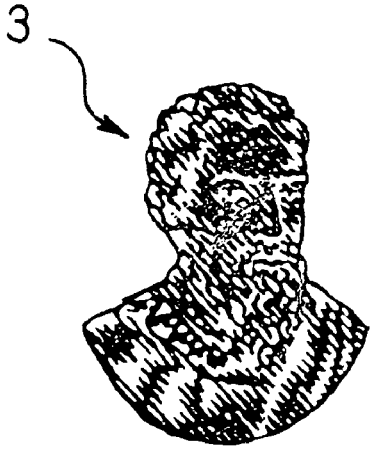
FIG. 2 is a diagram of a grid used for making the watermark of the invention.

FIG. 2 shows a grid constituting a set of masks 3 that can be used to make a watermark of the invention.

Figure 3:
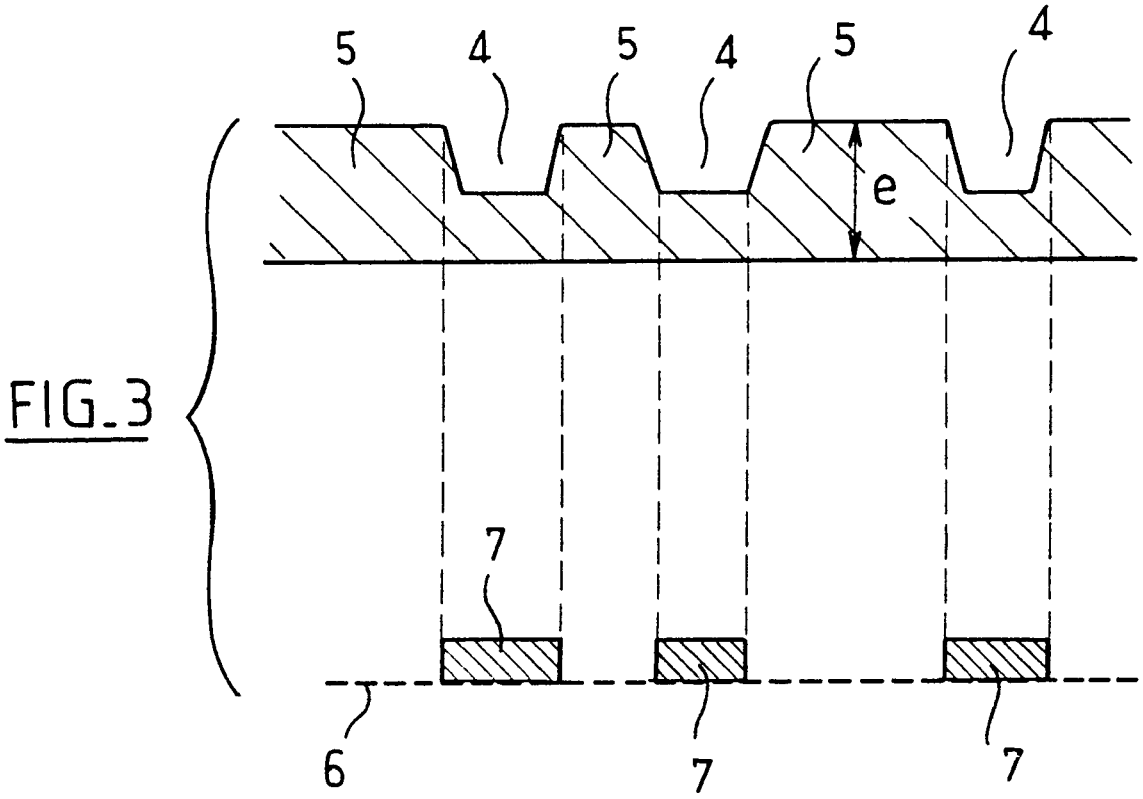
FIG. 3 is a fragmentary and diagrammatic section through the watermark showing the positions of the masks on the wire used for forming the paper.

FIG. 3 shows a section of the watermark 2 taken perpendicularly to the orientation of its screen.

In this figure, the pale zones 4 of the watermark correspond to regions in which the paper has a lower weight per unit area while the darker zones 5 correspond to regions of the paper having weight per unit area equal to that of the paper outside the watermark.

In the embodiment described, the pale zones correspond to indentations in the paper while the dark zones correspond to regions where the paper is of constant thickness e.

To make the pale zones, i.e. the indentations in the surface of the paper, the set of masks 3 is placed on a wire 6 that is used during formation of the paper by the wet method, for example.

The wire 6 is provided with the set of masks 3 on one of its faces, preferably its face that comes into contact with the aqueous suspension of fibers.

Each unit mask 7 in the set of masks 3 restricts fiber accumulation at the surface of the wire 6 during the paper-forming process, as illustrated in FIG. 3.

The depth of the indented portions corresponding to the pale zones of the watermark can lie, for example, in the range 50% to 90% of the total thickness e of the paper.

To make the set of masks 3, it is possible to proceed as follows, for example. Starting from a scanned image of a portrait or any other subject that is to serve as the basis for the watermark, a screened image is made in conventional manner, e.g. by means of software such as that sold by Adobe under the trademark Photoshop.

Such software makes it possible in particular to select the shape of the screen marks, their pitch, and the screening method used for making the screened image.

The simplest screened image to obtain is a half-tone image, i.e. the shades of gray in the scanned image are represented in the screened image by black screen marks on a white background.

The screening method can be a screening method implementing amplitude modulation, i.e. the size of the screen marks varies as a function of the optical density to be reproduced.

It is also possible to use a frequency modulation screening method, i.e. the size of the screen marks remains constant but the spacing thereof varies as a function of the optical density to be replicated.

It is also possible to use any other known screening method, for example a screening method in which the way in which the screen marks are constructed varies depending on the optical density to be replicated, in particular to accommodate problems of reproducing the screened image while forming the watermark.

It is also possible for various regions of the scanned image to be screened in different manners, and in particular when the screen marks used are constituted by lines, certain portions of the scanned image can be reproduced using lines at a first given inclination while other portions of the scanned image can be reproduced with lines at a different inclination.

Within the same screened image, it is possible to have a plurality of regions, e.g. three or four, in which the screen marks are constituted by lines at different orientations.

For example, the beard of the person shown in FIG. 1 can be screened using screen marks that are constituted by lines at an orientation that is different from the lines used for reproducing the remainder of the image.

The screened image as produced by the software is advantageously retouched in order to accommodate special problems associated with reproducing the image in the form of a watermark.

The above-mentioned software can be used to obtain a screened image that is the negative of the scanned image.

The negative image is likewise a screened image and it is advantageously retouched so as to ensure that no isolated dark zone exists.

Such a retouched image can resemble the image of FIG. 2, for example.

Figure 4:
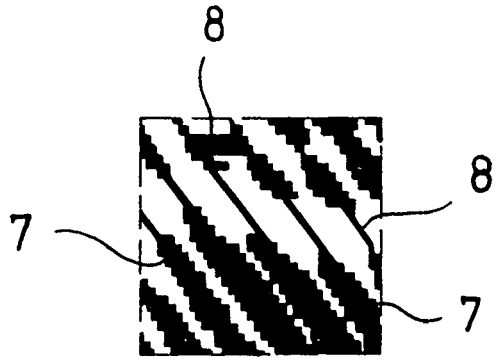
FIG. 4 shows a detail of the FIG. 2 grid.

During retouching, and as shown in FIG. 4, it is possible to interconnect two adjacent dark lines by bridges of material 8, possibly in order to improve the appearance of the image but above all to enable a perforated element to be made in which the solid portions correspond to the black zones of the negative screened image of FIG. 2, for example.

As can be seen in FIG. 2, there are no isolated black zones, i.e. all of the masks 3 can be made as a single piece by etching.

A perforated plate is thus obtained having solid portions in the form of slanting lines which correspond to the black screen marks of the negative screened image of FIG. 2, these slanting line solid regions being interconnected by solid connection regions 8 extending between them and obtained when retouching the initial screened image.

While forming the watermark in the manner explained above, such a perforated plate produces a positive image in which the pale zones correspond to the black zones of the screened negative image of FIG. 2 and the dark zones correspond to the perforations in the plate.

By way of example, the set of masks 3 used for forming the watermark can be obtained by etching a photosensitive plate exposed through a film that reproduces the negative screened image of FIG. 2.

In a variant, the set of masks 3 can be made by cutting out a fine plate made of metal or plastics material.

It will be understood that it is advantageous to retouch the screened image obtained by the software from a scanned image since that makes it possible to obtain a set of masks constituting a single piece, as explained above.

Nevertheless, the invention is not limited to this particular embodiment and it would be quite possible to use a screened image without retouching it by applying a set of individual pieces to the wire used for making the watermark.

What is claimed is:

1. Paper based on a fiber composition, the paper comprising at least one multitone effect watermark, wherein the watermark, when observed in transmitted light, has a set of dark zones and a set of pale zones arranged in the manner of a screened image, and the pale zones have a weight per unit area of fiber composition that is less than that of the dark zones.

2. Paper according to claim 1, wherein the dark zones have a weight per unit area of fiber composition that is the same as that of the remainder of the paper.

3. Paper according to claim 1, wherein the watermark appears as a screened image whose screen marks are constituted at least 50% by lines.

4. Paper according to claim 1, wherein the pale zones all have the same weight per unit area of fiber composition.

5. Paper according to claim 1, the paper being at least one of colored, fluorescent or iridescent.

6. Paper according to claim 1, wherein the screened image represents a portrait.

7. Paper according to claim 1, wherein the screen of the screened image has amplitude modulation using a constant pitch.

8. Paper according to claim 7, wherein the pitch lies in the range of five lines per centimeter to 20 lines per centimeter.

9. Paper according to claim 1, wherein the screen of the screened image has frequency modulation.

10. Paper according to claim 3, wherein the lines are inclined at 45°.

11. Paper according to claim 1, wherein the pale zones have a reduced thickness compared to that of the dark zones.

12. Paper according to claim 1, wherein the pale zones are constituted by indentations in the fiber composition.

* * * * *